United States Patent [19]

Sidwell

[11] Patent Number: 4,765,610

[45] Date of Patent: Aug. 23, 1988

[54] ACCESSORY FOR WEIGHTLIFTING EQUIPMENT

[76] Inventor: David A. Sidwell, R.R. 1, Box 267, Solon, Iowa 52333

[21] Appl. No.: 898,938

[22] Filed: Aug. 21, 1986

[51] Int. Cl.[4] ..... A63B 21/06

[52] U.S. Cl. ..... 272/117; 272/134

[58] Field of Search ..... 272/117, 118, 123, 129, 272/130, 131, 134, DIG. 4; 128/25 R

[56] References Cited

U.S. PATENT DOCUMENTS

| | | | |
|---|---|---|---|
| 3,573,865 | 4/1971 | Annas | 272/117 |
| 3,588,101 | 6/1971 | Jungreis | 272/117 |
| 4,249,726 | 2/1981 | Faust | 272/123 |
| 4,253,662 | 3/1981 | Podolak | 272/123 |
| 4,540,171 | 9/1985 | Clark et al. | 272/123 X |
| 4,563,003 | 1/1986 | Bugallo et al. | 272/118 |
| 4,650,185 | 3/1987 | Cartwright | 272/127 X |

FOREIGN PATENT DOCUMENTS

| | | | |
|---|---|---|---|
| 878320 | 11/1981 | U.S.S.R. | 272/118 |

*Primary Examiner*—Richard J. Apley
*Assistant Examiner*—Robert W. Bahr
*Attorney, Agent, or Firm*—James C. Nemmers

[57] ABSTRACT

An accessory for weightlifting equipment that serves as a mechanical training partner for the weightlifter. The accessory is an electrically-powered, mechanically-driven device that provides a positive assist to enable the lifter to keep lifting even after muscle fatigue or failure. The accessory also provides a negative assist by applying more force as the weight is lowered. Both positive and negative assists are under full control of the lifter using foot or hand controls. The accessory also acts as a safety device which can control the weight if the lifter has problems or feels injured during a positive lift.

3 Claims, 2 Drawing Sheets

FIG 1
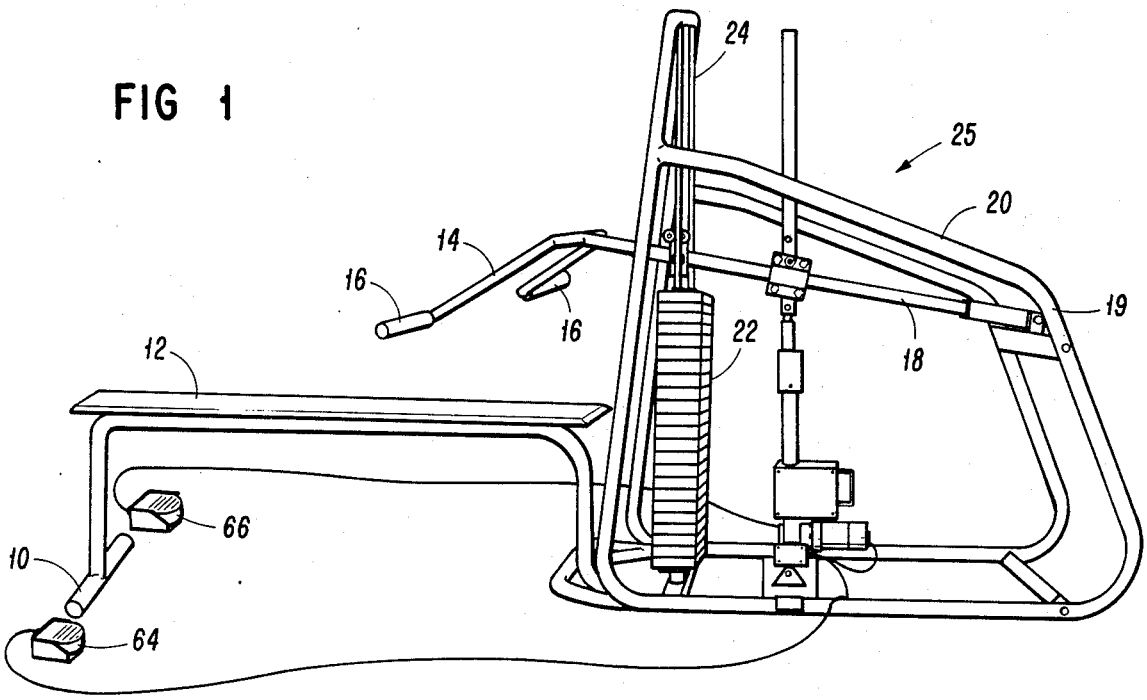
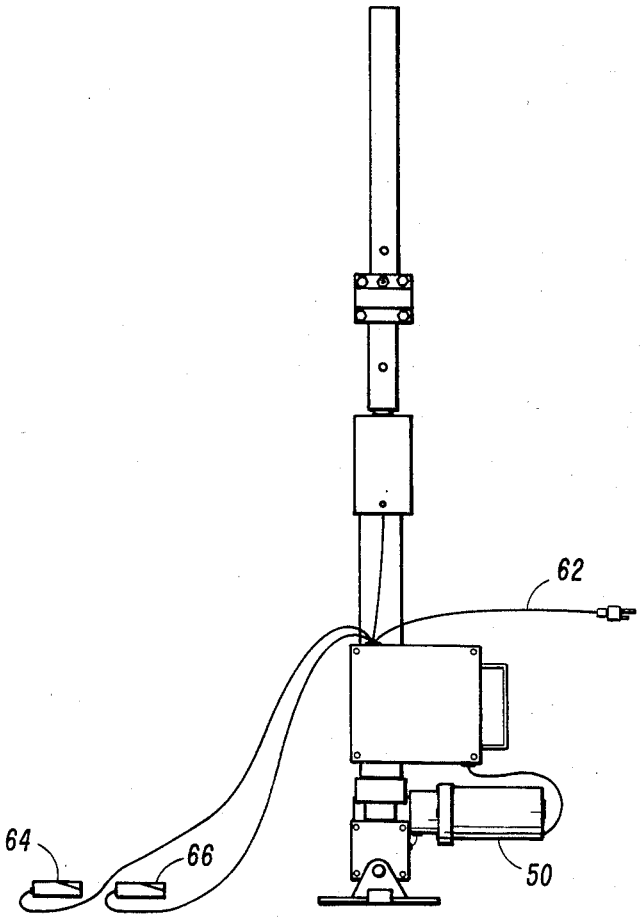
FIG 2

ACCESSORY FOR WEIGHTLIFTING EQUIPMENT

BACKGROUND OF THE INVENTION

In recent years, fitness equipment, including weight lifting apparatus using weight stacks and free weights, have become increasingly popular. There are many types of weight lifting apparatus commercially available in which the user performs various exercises to build up muscle tissue. All of these devices exercise muscle tissue by having the user push or pull against a weight on the apparatus which is connected to bars or other hand or foot devices on the apparatus against which the user pushes or pulls. When such devices are used with proper supervision, it is usually recommended for strength training that a spotting partner assist the user by helping the user to continue to lift the weight in the event that "burn-out" occurs. Burn-out occurs when muscle fatigue sets in or when the user has exceeded his physical limitations and cannot proceed through a portion of the lift. Also, with such apparatus, once the weight is lifted, the device is not designed to provide any force in the reverse direction. In other words, once the weight has been raised against the force of gravity, the user with the force of gravity will return the weights to the original position for the next exercise repetition.

It has been discovered that beneficial effects can be achieved by having the user resist movement of the weights back downwardly, after a positive lift. This is commonly termed a "negative rep". With present lifting apparatus this "negative rep" can be accomplished only if the spotter, who is assisting the user, actually forces the weights downward manually.

Even in situation where a spotter or an assistant is available, a spotter must estimate the amount of aid necessary to assist the lifter. Essentially, this estimate may be in error. Also, unless the spotter is well trained, a jerking action throughout the range of motion can occur.

There is therefore a need for a device that can be used in place of the human training assistant or spotter which would shorten lifting schedules and reduce workout time. Moreover, a mechanical assisting device that is properly designed will actually improve the quality and efficiency of the assists and allow the positive and negative spotting to be fully under the control of the user.

SUMMARY OF THE INVENTION

The invention consists of basically a power unit and a clutch bar. The accessory is attached to any weight machine using stack weights or free weights. A power unit controls an electric motor that through a gear arrangement controls the vertical movement of a clutch bar which is connected to the weight stack. The clutch bar permits the weight to move freely upwardly and downwardly when the accessory is off. User-controlled switches operate the power unit which will engage the clutch bar and cause the weight to move upwardly. If the user is lifting the weight and reaches the point of burn-out, the user can press a control switch and continue the lift at a predetermined speed with the assist of the power unit. The lifting accessory also provides a negative assist in that after it is positively engaged with the weight the accessory can create a controlled downward force, greater than the weight being lifted, that the user can resist.

BRIEF DESCRIPTION OF THE DRAWINGS

FIG. 1 is a perspective view of a weight machine and showing the accessory of the invention combined with the weight stack;

FIG. 2 is a side elevational view of the accessory of the invention;

DESCRIPTION OF THE PREFERRED EMBODIMENT OF THE INVENTION

Figure 3:
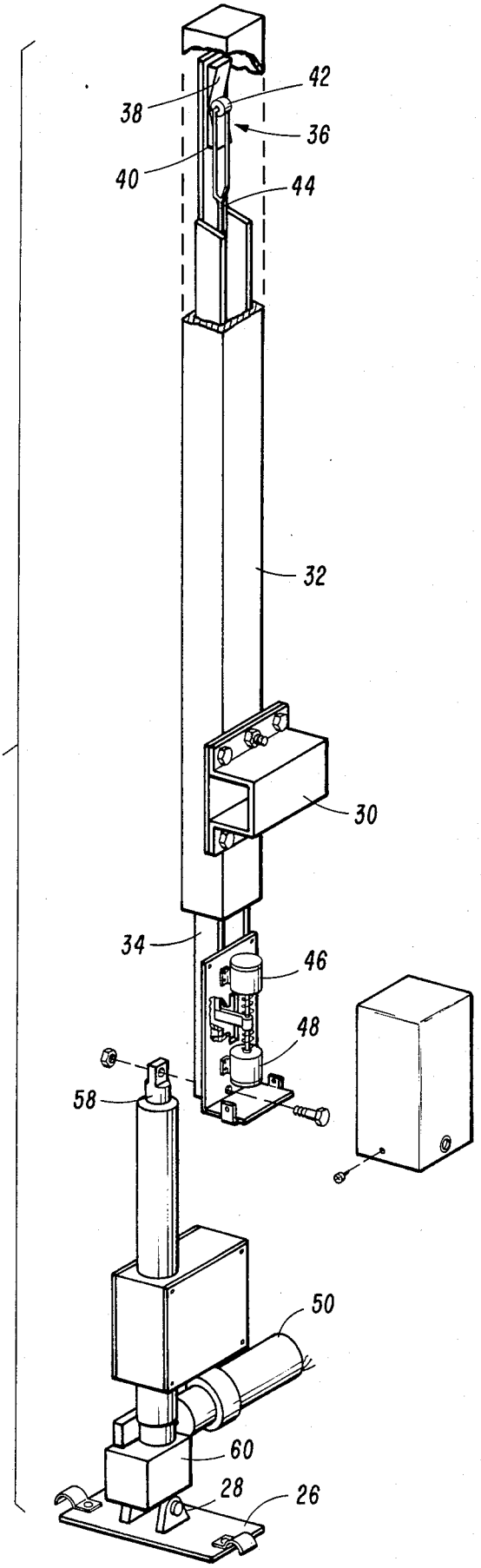
FIG. 3 is a perspective view, partially exploded, further illustrating the mechanism of the invention.

Referring first to FIG. 1, there is illustrated a weight machine which has a base 10 that supports a bench 12 upon which the user lies with his or her arms beneath bars 14 which have spaced-apart handles 16 to be grasped by the user. Bars 14 are connected to an arm 18 that is pivotally mounted at the opposite end to a supporting framework 20. Contained within the supporting framework is a weight stack 22 which, as is well known to those skilled in the art, consists of a number of individual weights which can be varied depending upon the wishes of the user. The weight stack 22 is vertically moveable upwardly and downwardly on vertical guides 24 the weight stack being pivotally connected to the arm 18 at a point between the pivotal connection 19 and the bars 14. Thus, as the user lies on the bench 12 and grasps the handles 16, the user can push upwardly to raise the weight stack to provide the necessary force that stresses and builds the muscles involved. Obviously, by lowering the handles 16, the user also lowers the weight stack, aided by the force of gravity.

The foregoing is a brief description of the basics of a standard weight machine that is currently commercially available and widely used. As previously indicated, whenever the weight stack 22 is lifted this movement stresses and builds the muscles involved. Normally, a training partner assists the positive movement by supplying just enough extra force to enable the lifter to keep lifting after muscle fatigue and failure occurs. This is termed a "force repetition" and is used to more fully stress, and therefore strengthen, the muscles involved. On the other hand, a negative movement occurs whenever the weight stack 22 is lowered uncontracting the muscles involved. A training partner assists the negative movement by applying additional force to the bars 14 while the lifter resists against it. Since muscle tissue is designed to be capable of resisting more weight in the negative mode than it can lift in the positive mode, a lifter with any given amount of weight will put more stress by himself on the positive movement than the negative. The forced negative assist will then put more stress on the muscle tissue for optimum strength and muscle gains.

The accessory of the invention is indicated generally by the reference numeral 25, and as shown in FIG. 1, the accessory 25 is secured to framework 20 by attachment to the arm 18 between its pivot point 19 and the handles 14. The accessory 25 includes a base 26 affixed to framework 20 with a pivotal connection 28. A bracket 30 provides for sliding attachment of the accessory 25 to the arm 18. Bracket 30 is affixed to the tubular member 32 which therefore moves upwardly and downwardly with the movement of the weight stack 22. An operating rod 34 normally is moveable upwardly and downwardly inside of the tubular member 32. Thus, normally, when the accessory of the invention is not "on", the user can operate the weight machine in the normal manner, and the tubular member 32 will move freely. However, when the accessory of the invention is actuated for either a positive assist or a negative assist, a clutch mechanism, indicated generally by the reference numeral 36, will lock the member 34 to the tubular member 32 and prevent their relative movement. Clutch mechanism 36 consists of a negative ramp 38 and a positive ramp 40 upon which ride a roller 42 that is attached to an operating rod 44 that extends through the center of the vertical member 34. Operating rod 44 is attached at its lower end to a pair of solenoids 46 and 48. When solenoid 46 is actuated, it will cause the operating rod 44 to move upwardly driving the roller 42 onto the negative ramp 38. Similarly, when solenoid 48 is actuated, the operating rod 44 will be pulled downwardly driving the roller 42 onto the positive ramp 40. In either position, the vertical member 34 will be locked to the tubular member 32 so that they will then move together.

Figure 4:
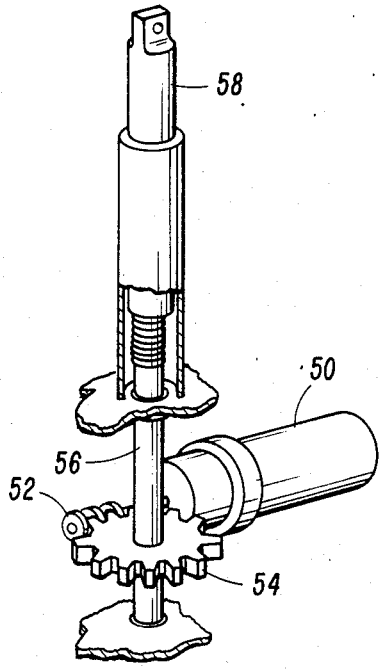
FIG. 4 is a perspective view with components partly in section and partly broken away to show the drive mechanism of the accessory of the invention.

In order to provide either a positive or negative assist, there is secured to the base an electric motor 50 which is preferably a variable speed, reversible motor. Motor 50 drives a worm gear 52 which in turn rotates a gear 54 secured to a vertical drive shaft 56 the upper end of which is threaded as best seen in FIG. 4. The threaded end of drive shaft 56 is turnable inside of tube 58 which is connected to the lower end of the member 34 as best seen in FIG. 3. Thus, when gear 54 rotates and turns drive shaft 56, the tube 58 will either move upwardly or downwardly depending on the direction of rotation of the gear 54. Obviously, when tubular member 58 moves upwardly or downwardly, it will move either upwardly or downwardly the member 34. Also, in the event that the clutch mechanism 36 is engaged, movement of member 34 will also cause the tubular member 32 to move upwardly or downwardly.

The electric motor is supplied from a source of power (not shown) by connection of the power cord 62 to that source of power. Control of the motor, both in speed and direction of rotation, is controlled by a pair of switches 64 and 66 which are positioned beneath the bench 12 so as to be operable by the feet of the user. Switch 64 controls the motor 50 so that the members 32 and 34 will be moved upwardly to provide a positive assist, whereas switch 66 controls the motor so as to move members 32 and 34 downwardly to provide a negative assist. Simultaneously with actuation of the motor 50 in either direction, either solenoid 46 or 48 will be actuated so as to engage the clutch mechanism 36 for either a positive assist or a negative assist.

The invention permits the utilization of information that is not available from conventional weight-lifting equipment. If desired, bio-feed back data can be made available from the motor 50 to inform the user exactly what the accessory is lifting as opposed to what the user is lifting. This allows the user to measure the progress that he or she is making.

In operation, with a user lying on the bench 12 and grasping the handles 16 and pushing them upwardly, if the user senses that muscle failure or fatigue is approaching, the user would engage the switch 64 which will in turn engage the clutch 36 by moving the roller 42 downwardly onto positive ramp 40. Motor 50 will also be started to move the member 34 and thus the tubular member 32 upwardly thus causing the weight stack 22 to be lifted slowly while the user continues to apply as much force as possible. If a negative assist is desired, the user would release the positive assist switch 64 when the upper limit of his lift is attained, and then press the negative assist switch 66. Solenoid 46 will be actuated to move the roller 42 upwardly onto the negative ramp 38 and once again lock the member 34 to the tubular member 32. Simultaneously, motor 50 will be reversed to reverse the direction of movement of the member 32 from upwardly to downwardly. This will then add resistance to the weight in the negative movement while the user strains against it. Thus, the invention provides a useful accessory for weight machines that eliminates the necessity of a lifting partner and provides safety. The design of the clutch assembly will prevent the unit from becoming disengaged during the positive assist when the user can not control the weight being lifted.

Having thus described the invention in connection with a preferred embodiment thereof, it will be evident to those skilled in the art that various revisions and modifications can be made to the preferred embodiment without departing from the spirit and scope of the invention. It is our intention however that all such revisions and modifications as are evident to those skilled in the art will be included within the scope of the following claims.

What is claimed is:

1. An accessory for use with weightlifting equipment which equipment has a weight means or the like that is raised and lowered by the user to build muscle tissue, said accessory comprising an electric motor, a rotatable member operatively connected to the motor and driven thereby, a vertically moveable means operatively connected to the weight means, means for translating the rotatable movement of said member into vertical movement of said vertically moveable means to selectively apply force to the weight means to assist in lifting the weight means and also to apply controlled downward force while the weight means is lowered by the user, a clutch for engaging and disengaging the motor from the weight means and allowing free movement of the weight means when the motor is disengaged therefrom, said clutch including a first vertically moveable member operatively connected with the motor and a second vertically moveable member that is operatively connected with the weight means and moveable relative to the first vertically moveable member, means to selectively prevent relative movement between the first and second vertically moveable members, and user-operated control means to operate the motor so as to selectively cause the application of force to the weight means during either the lifting of lowering of the weight means by the user.

2. The accessory of claim 1 in which the motor is reversible, and the user-operated control means is operable to operatively connect the motor and the weight means at any time during either the lifting or lowering of the weight means by the user.

3. An accessory for use with weightlifting equipment which equipment has a weight means or the like that is raised and lowered by the user to build muscle tissue, said accessory comprising power means operatively connectable to the weight means to selectively apply force to the weight means to assist in lifting the weight means and also to apply controlled downward force while the weight means is lowered by the user, said power means including an electric motor and a rotatable member operatively connected to and driven by the motor, means for translating the rotatable movement of said member into vertical movement, a clutch for engaging and disengaging the power means from the weight means and allowing free movement of the weight means when the power means is disengaged therefrom, said clutch including a first vertically moveable member operatively connected with the power means and a second vertically moveable member operatively connected with the weight means and moveable relative to the first member, locking means to selectively prevent relative movement between the first and second vertically moveable members, and user-operated control means for controlling said locking means so as to immediately engage or disengage the power means and the weight means at any time during either the lifting or lowering of the weight means thereby to selectively cause the power means to apply force to the weight means during either the lifting or lowering of the weight means by the user.

* * * * *